US006501845B2

(12) United States Patent
Gotoh et al.

(10) Patent No.: US 6,501,845 B2
(45) Date of Patent: Dec. 31, 2002

(54) ELECTROACOUSTIC TRANSDUCER

(75) Inventors: Youichi Gotoh, Sizuoka (JP); Yoshiharu Oishi, Sizuoka (JP); Takao Katsuki, Shizuoka (JP); Susumu Tanikawa, Shizuoka (JP); Morimasa Fushimi, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 0 days.

(21) Appl. No.: 09/941,773

(22) Filed: Aug. 30, 2001

(65) Prior Publication Data

US 2002/0025058 A1 Feb. 28, 2002

(30) Foreign Application Priority Data

Aug. 30, 2000 (JP) ..... 2000-261697
Jun. 20, 2001 (JP) ..... 2001-186945

(51) Int. Cl.[7] ..... H04R 1/00
(52) U.S. Cl. ..... 381/412; 381/409
(58) Field of Search ..... 381/150, 417, 381/412, 396, 399, 407, 409, 410; 340/825.46, 311.1; 367/175

(56) References Cited

U.S. PATENT DOCUMENTS 5,923,769 A * 7/1999 Fushimi ..... 381/338
6,023,519 A * 2/2000 Tajima et al. ..... 381/412

* cited by examiner

*Primary Examiner*—Sinh Tran
(74) *Attorney, Agent, or Firm*—Sughrue Mion, PLLC

(57) ABSTRACT

There is provided an electroacoustic transducer 1 including a base 24 made of magnetic material, a magnetic core 22 made of magnetic material and provided erectly on the base 24, a diaphragm 20 made of magnetic material and supported with a gap between the diaphragm and a forward end of the magnetic core, a magnet 25 constituting a magnetic circuit together with the base 24, the magnetic core 22 and the diaphragm 20 so as to provide a magnetostatic field, a coil 23 disposed around the magnetic core for applying an oscillating magnetic field to the magnetic circuit, a coil bobbin 30 for holding the coil 23, and a housing 10 for receiving these above-mentioned members. The coil bobbin 30 is integrally molded with the magnetic core 22 and the base member 24.

7 Claims, 6 Drawing Sheets

ELECTROACOUSTIC TRANSDUCER

BACKGROUND OF THE INVENTION

1. Field of the Invention

The present invention relates to an electroacoustic transducer which generates a sound by means of electromagnetic acoustic conversion.

2. Description of the Related Art

An electroacoustic transducer has a magnetic circuit in which a magnetic field from a magnet passes through a base member, a magnetic core and a diaphragm, and returns to the magnet again. When an electric oscillating signal is supplied to a coil disposed around the magnetic core, an oscillating magnetic field generated by the coil is superimposed on the magnetostatic field of the magnetic circuit so that oscillation generated in the diaphragm is transmitted to air. Thus, sound is generated.

The electroacoustic transducer is provided with terminals for supplying a current to a coil, and the terminals are often connected to a wiring pattern of a circuit board by soldering or the like in the same manner as other electronic parts.

Methods for winding the coil so as to mount the coil on the surrounding of the magnetic core are roughly classified into a) a direct winding method in which a coil wire is wound around a coil bobbin after the coil bobbin is fitted to the magnetic core, and b) a separate winding method in which a coil wire is wound around a reusable coil bobbin, the shape of the coil is fixed by bonding or the like, and thereafter the coil is taken out from the coil bobbin and mounted on a transducer.

The separate winding method is superior in mass productivity of coil. However, when a coil is mounted on a transducer, a lead wire of the coil is extremely thin so that caution is required in coil terminal treatment for connecting the lead wire to terminals. This caution becomes the bottleneck for the improvement of the productivity.

On the other hand, the direct winding method indeed has an advantage that coil winding and coil terminal treatment can be carried out simultaneously. However, a coil bobbin is required so that the number of parts or the number of man-hour for assembling increases.

SUMMARY OF THE INVENTION

It is an object of the present invention to provide an electroacoustic transducer in which the number of parts and the manufacturing cost can be prevented from increasing, and the assembling strength and the reliability of the electroacoustic transducer can be improved.

According to the present invention, there is provided an electroacoustic transducer comprising: a base member made of magnetic material; a magnetic core made of magnetic material and provided erectly on the base member; a diaphragm made of magnetic material and supported with a gap between the diaphragm and a forward end of the magnetic core; a magnet constituting a magnetic circuit together with the base member, the magnetic core and the diaphragm so as to provide a magnetostatic field; a coil disposed around the magnetic core for applying an oscillating magnetic field to the magnetic circuit; a coil bobbin interposed between the magnetic core and the coil for holding the coil; and a housing member for receiving the base member, the magnetic core, the diaphragm, the magnet, the coil and the coil bobbin; wherein the coil bobbin is molded integrally with the magnetic core and the base member.

According to the present invention, the coil bobbin is molded integrally with the magnetic core and the base member by insert molding or the like. Thus, it is not necessary to bond the coil bobbin. It is therefore possible to improve the fixation strength of the coil bobbin to the magnetic core and the base member and it is possible to reduce the number of parts and the manufacturing cost.

Further, according to the present invention, there is provided an electroacoustic transducer comprising: a base member made of magnetic material; a magnetic core made of magnetic material and provided erectly on the base member; a diaphragm made of magnetic material and supported with a gap between the diaphragm and a forward end of the magnetic core; a magnet constituting a magnetic circuit together with the base member, the magnetic core and the diaphragm so as to provide a magnetostatic field; a coil disposed around the magnetic core for applying an oscillating magnetic field to the magnetic circuit; a housing member for receiving the base member, the magnetic core, the diaphragm, the magnet and the coil; terminals for supplying an electric current from the outside to the coil; and an electrically insulating member for electrically insulating the base member from the terminals; wherein the electrically insulating member is molded integrally with the base member.

According to the present invention, the electrically insulating member for electrically insulating the base member from the terminals is molded integrally with the base member by insert molding or the like. Thus, it is not necessary to bond the electrically insulating member. It is therefore possible to improve the fixation strength of the electrically insulating member to the base member and it is possible to reduce the number of parts and the manufacturing cost.

Further, according to the present invention, preferably, the electrically insulating member is molded integrally with the terminals.

According to the present invention, the electrically insulating member is molded integrally not only with the base member but also with the terminals by insert molding or the like. Thus, it is not necessary to bond the terminals. It is therefore possible to improve the fixation strength of the terminals and it is possible to reduce the number of parts and the manufacturing cost.

Further, according to the present invention, preferably, an external surface of the base member is covered with the electrically insulating member.

According to the present invention, when the base member and the electrically insulating member are molded integrally by insert molding or the like, the external surface of the base member is covered with the electrically insulating member. Thus, the quantity of a sealer to be used for sealing the bottom surface of the transducer can be reduced largely. In addition, the base member is not exposed to the outside. Thus, the base member can be prevented from short-circuit, dew condensation, or oxidation.

Further, according to the present invention, preferably, each of the terminals has a stopper portion for engaging with the electrically insulating member.

According to the present invention, a stopper portion for engaging with the electrically insulating member is formed in each of the terminals. Thus, it is possible to improve the fixation strength of the terminals to the electrically insulating member.

Further, according to the present invention, preferably, the electroacoustic transducer further has a coil bobbin for holding the coil, and the coil bobbin is molded integrally with the electrically insulating member.

According to the present invention, the coil bobbin and the electrically insulating member are molded integrally by injection molding or the like. Thus, it is not necessary to bond the coil bobbin. It is therefore possible to improve the fixation strength of the coil bobbin to the electrically insulating member and it is possible to reduce the number of parts and the manufacturing cost.

DETAILED DESCRIPTION OF THE PRESENT INVENTION

The present invention will be described in detail with reference to the accompanying drawings.

Figure 1:
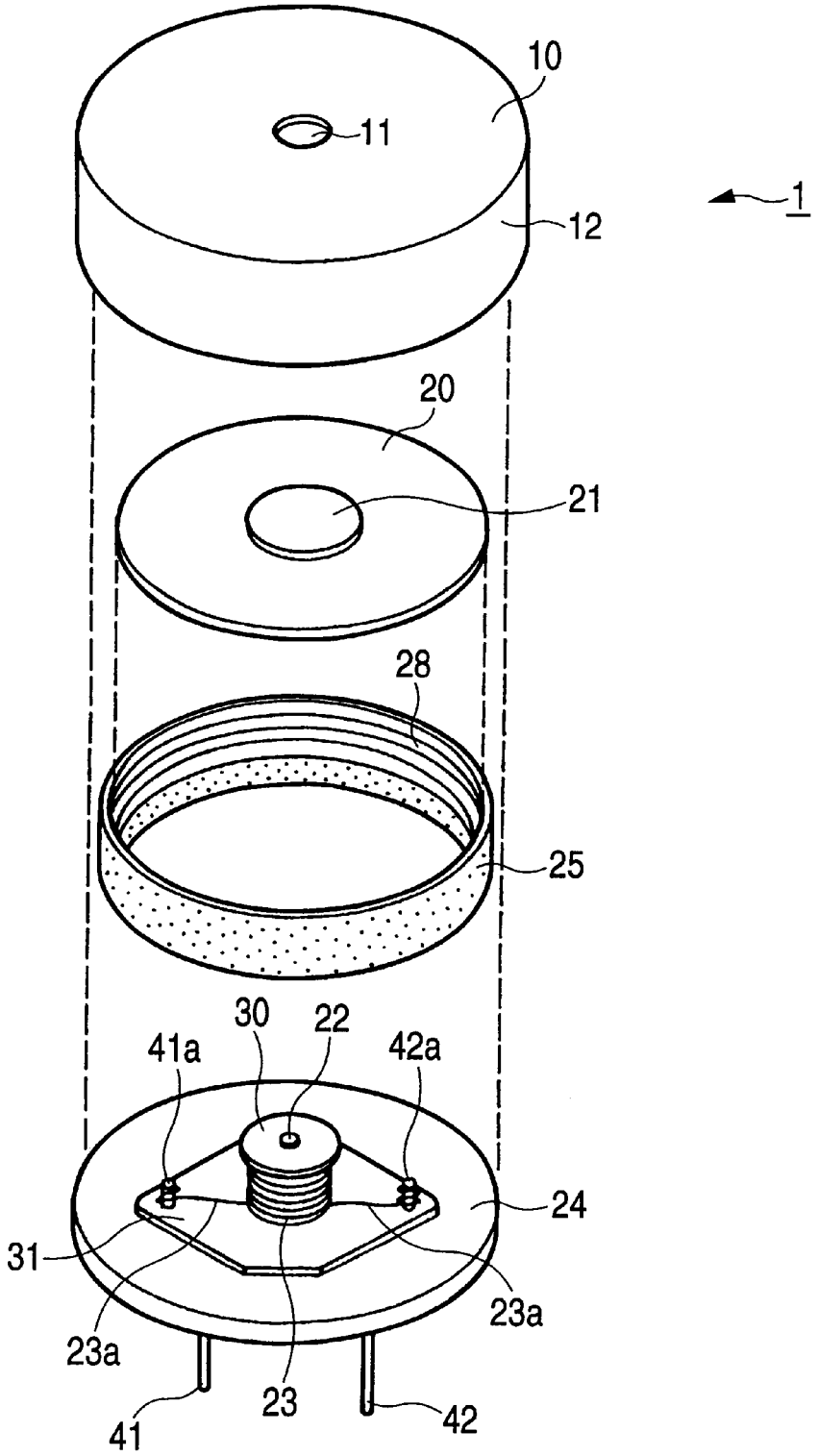
FIG. 1 is an exploded perspective view showing an embodiment of the present invention.
Figure 2:
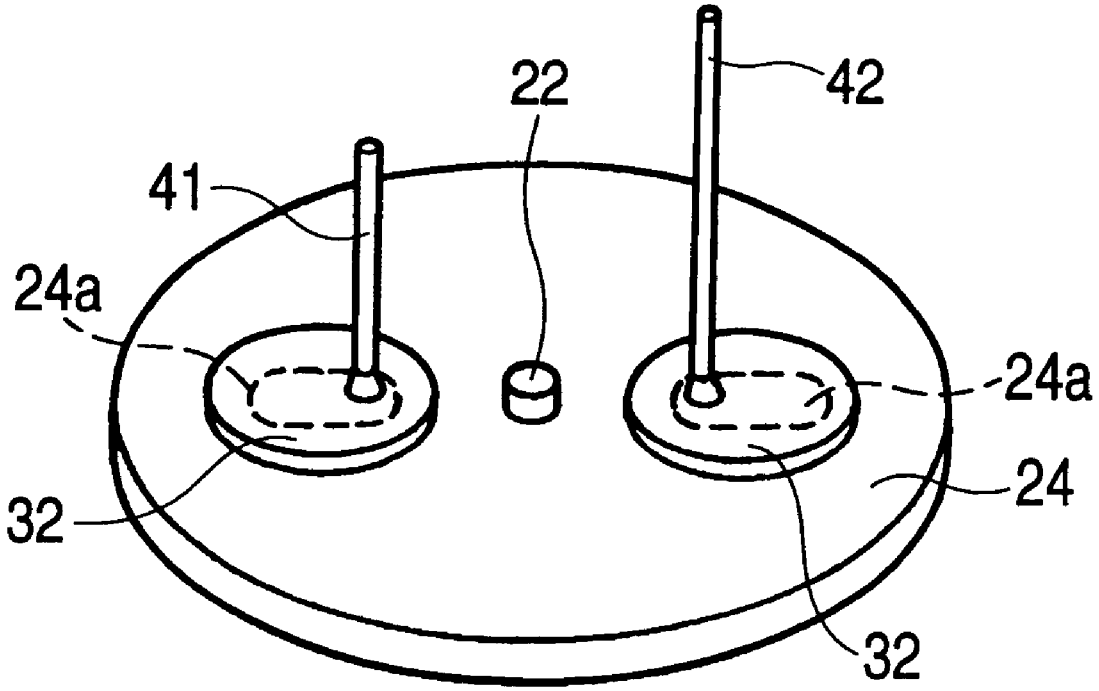
FIG. 2 is a perspective view showing the back surface side of a base 24.
Figure 3A:
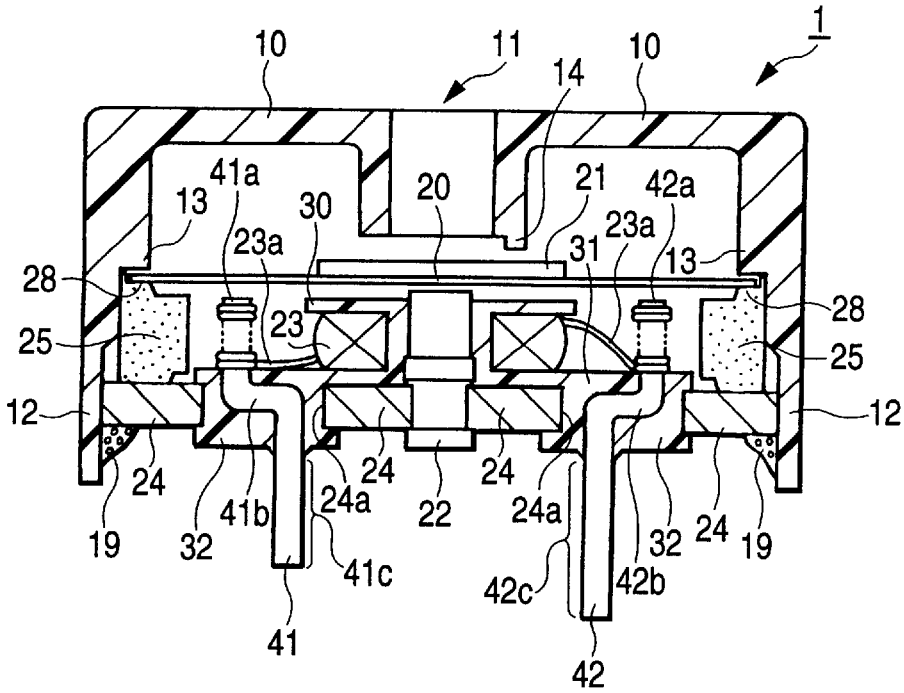
FIG. 3A is a sectional view taken on line vertical center line showing the embodiment of the present invention.
Figure 3B:
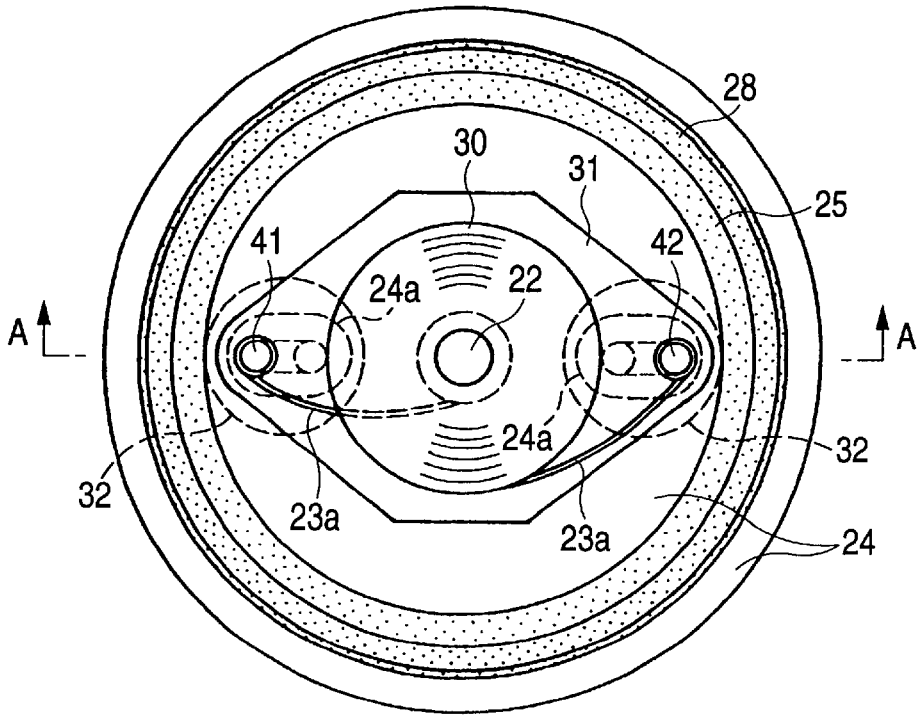
FIG. 3B is a plan view showing the state where a magnet 25 is mounted on the base 24.

FIG. 1 is an exploded perspective view showing an embodiment of the present invention. FIG. 2 is a perspective view showing the back surface side of a base 24. FIG. 3A is a sectional view taken on line vertical center line showing the embodiment of the present invention, and FIG. 3B is a plan view showing the state where a magnet 25 is mounted on the base 24.

An electroacoustic transducer 1 comprises a base 24, a magnetic core 22, a coil 23, a magnet 25 and a diaphragm 20, which are received in a housing 10. The electroacoustic transducer 1 is formed into a compressed column as a whole. For example, the entire size is about diameter 25 mm by body height 12 mm.

The base 24 is formed into a disc having a diameter to be loosely fitted into the inner diameter of the housing 10. Each of two elliptic through holes 24*a* is formed at a fixed distance from the center of the base 24. Lead terminals 41 and 42 pass through the elliptic through holes 24*a* respectively, and an electrically insulating portions 32 are attached to the base 24 to thereby prevent short-circuit between the base 24 and the lead terminals 41 and 42.

A columnar magnetic core 22 is provided erectly at the center of the base 24, and a coil 23 is disposed around the magnetic core 22. The base 24 and the magnetic core 22 are made of magnetic material. However, the base 24 and the magnetic core 22 may be formed integrally as a single pole piece member by caulking or the like.

The magnet 25 is formed into a ring and disposed on the base 24 coaxially with the magnetic core 22. An annular internal space is ensured between the magnet 25 and the coil 23.

The magnet 25 is also used as a support member for supporting the diaphragm 20. As shown in FIG. 3A, a plurality of annular steps are formed in the inner side of the magnet 25. The disc-like diaphragm 20 is mounted on an horizontal supporting step 28 which is one of the annular steps so that the circumferential edge portion of the diaphragm 20 is positioned by the horizontal supporting step 28.

The diaphragm 20 is made of magnetic material. A fixed gap is ensured between the back center of the diaphragm 20 and the forward end of the magnetic core 22. A disc-like magnetic piece 21 is fixed to the front center of the diaphragm 20 so as to increase the mass of the diaphragm 20. Thus, the efficiency of oscillation of the air is enhanced.

The housing 10 is made of synthetic resin such as thermoplastic resin or the like, into a cylindrical box fitted to the outer-diameter shape of the base 24. A restriction portion 13 for positioning the magnet 25 and the diaphragm 20 is formed in the internal surface of the circumferential wall 12 of the housing 10 so as to position and fix the magnet 25 without using any bonding agent.

The circumferential wall 12 of the housing 10 and the base 24 are sealed and bonded by a filler 19 such as a bonding agent or molding resin, as shown in FIG. 3A.

A sound release aperture 11 having a smaller diameter than that of the magnetic piece 21 is formed in the top plate of the housing 10 so as to be opposed to the diaphragm 20. A displacement restriction portion 14 is formed at a predetermined distance from the magnetic piece 21 in the lower surface of the sound release aperture 11.

A coil bobbin 30 for holding the coil 23 is fitted to the magnetic core 22. The coil bobbin 30 is made of electrically insulating material such as synthetic resin or the like. The coil bobbin 30 has an upper flange and a lower flange 31 for restricting the upper and lower ends of the coil 23 respectively. The coil bobbin 30, together with the electrically insulating portions 32, are molded integrally with the magnetic core 22, the base 24 and the lead terminals 41 and 42 by insert molding or the like. By such integral molding, it is not necessary to bond the coil bobbin 30, the electrically insulating portions 32 and the lead terminals 41 and 42. It is therefore possible to improve the fixation strength of the coil bobbin 30, the electrically insulating portions 32 and the lead terminals 41 and 42, and it is possible to reduce the number of parts and the manufacturing cost.

The lead terminals 41 and 42 are made of copper wires plated with solder, or the like. The lead terminals 41 and 42 have protrusion portions 41*a* and 42*a* protruding into the internal surface side of the base 24, bent portions 41*b* and 42*b* bent from the protrusion portions 41*a* and 42*a* toward the center, and exposed portions 41*c* and 42*c* protruding from the bent portions 41*b* and 42*b* into the external surface side of the base 24, respectively.

The protrusion portions 41*a* and 42*a* protrude in the coil axial direction so that the axis of rotation with which the coil wire 23*a* is wound around the coil bobbin 30 becomes substantially parallel with the axis of rotation with which the coil wire 23*a* is wound around each of the protrusion portions 41*a* and 42*a*.

According to such a configuration, by use of a coil winder, the coil wire 23*a* is first wound around the protrusion portion 41*a,* second around the coil bobbin 30, and finally around the protrusion portion 42*a.* Through such a step, coil winding and coil terminal treatment can be carried out by a series of steps. It is therefore possible to simplify the manufacturing process and to reduce the cost.

In addition, the coil wire 23*a* is connected to the protrusion portions 41*a* and 42*a* protruding into the internal surface side of the base 24. Thus, when the filler 19 is applied to the external surface side of the base 24, the coil wire 23*a* is prevented from being in contact with the filler 19. It is therefore possible to eliminate the stress imposed on the coil wire 23*a* in a thermal shock test or the like.

In addition, even if stress is imposed on the exposed portions 41*c* and 42*c* of the lead terminals 41 and 42 due to physical contact, soldering, or the like, it is difficult to transmit the stress from the exposed portions 41*c* and 42*c* to the protrusion portions 41*a* and 42*a.* It is therefore possible to reduce the stress imposed on the coil wire 23*a.*

The lower flange 31 of the coil bobbin 30 is formed to be broad enough to surround the protrusion portions 41*a* and 42*a.* By the lower flange 31, the coil wire 23*a* extending over the protrusion portion 41*a,* the coil bobbin 30 and the protrusion portion 42*a* is prevented from coming in contact with the base 24.

The bent portions 41*b* and 42*b* of the lead terminals 41 and 42 have a function to prevent the lead terminals 41 and 42 from being detached, and a function to convert the pitch of the protrusion portions 41*a* and 42*a* and the pitch of the exposed portions 41*c* and 42*c.*

If the lead terminals 41 and 42 are formed to be straight, the lead terminals 41 and 42 are fixed to the electrically insulating portions 32 simply by friction. On the other hand, if the bent portions 41*b* and 42*b* are formed in the middle portions of the lead terminals 41 and 42, the lead terminals 41 and 42 are engaged with the electrically insulating portions 32 firmly. Accordingly, the lead terminals 41 and 42 can be surely prevented from being detached from the electrically insulating portions 32 in the longitudinal direction.

In addition, it is necessary to ensure a space between each of the protrusion portions 41*a* and 42*a* and the coil bobbin 30 so that an arm head of the coil winder can pass through the space. When the bent portions 41*b* and 42*b* are provided thus, the pitch of the exposed portions 41*c* and 42*c* can be adjusted flexibly to the shapes of lands formed on an external circuit board.

Next, the operation will be described. The magnet 25 is magnetized in the direction of thickness so that the bottom and the top of the magnet 25 are magnetized into N and S poles respectively by way of example. In this case, magnetic line of force from the bottom of the magnet 25 passes through the circumferential edge portion of the base 24, the center portion of the base 24, the magnetic core 22, the center portion of the diaphragm 20, the circumferential edge portion of the diaphragm 20 and the top of the magnet 25. Thus, a closed magnetic circuit is formed as a whole. The magnet 25 has a function to apply a magnetostatic field to such a magnetic circuit. The diaphragm 20 is supported stably by this magnetostatic field in the condition that the diaphragm 20 is attracted toward the magnetic core 22 and the magnet 25.

When an electric oscillating signal is supplied from the circuit board through the lead terminals 41 and 42 and the coil wire 23*a* to the coil 23 which is wound around the magnetic core 22, the coil 23 applies an oscillating magnetic field to the magnetic circuit. Thus, the diaphragm 20 oscillates due to the superimposition of the oscillating magnetic field on the magnetostatic field so as to oscillate the air on the front surface side of and on the back surface side of the diaphragm 20.

Sound generated on the front surface side of the diaphragm 20 is released to the external environment through the sound release aperture 11. Sound generated on the back surface side of the diaphragm 20 has a phase inverse to that of the sound generated on the front surface side of the diaphragm 20. Therefore, by confining the sound generated on the back surface side of the diaphragm 20 in the annular internal space, the interference of the sound generated on the back surface side of the diaphragm 20 with the sound generated on the front surface side of the diaphragm 20 is restrained to be as small as possible.

Figure 4A:
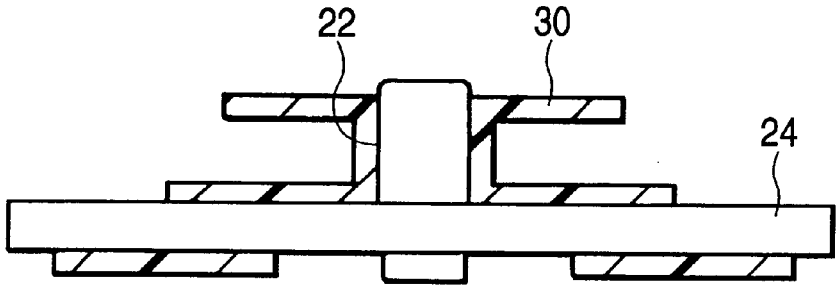
FIG. 4A is an explanatory view showing an embodiment of integral molding of a base 24, a magnetic core 22 and a coil bobbin 30.
Figure 4B:
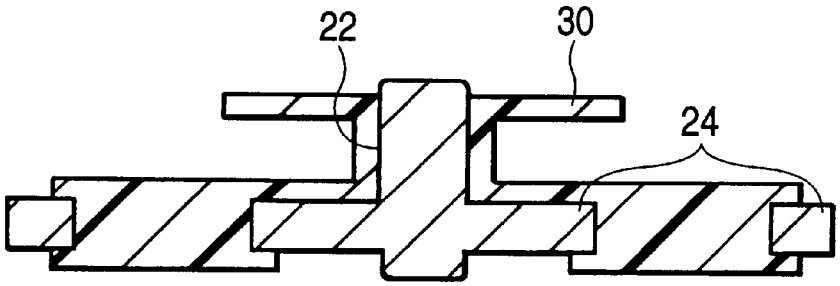
FIG. 4B is a sectional view taken on vertical center line of FIG. 4A.

FIG. 4A is an explanatory view showing an embodiment of integral molding of the base 24, the magnetic core 22 and the coil bobbin 30. FIG. 4B is a sectional view taken on vertical center line of FIG. 4A. After the base 24 and the magnetic core 22 are integrated by caulking, the base 24 and the magnetic core 22 are mounted on a mold for the coil bobbin 30 so as to be insert-molded. Thus, the base 24, the magnetic core 22 and the coil bobbin 30 are molded integrally.

Figure 5:
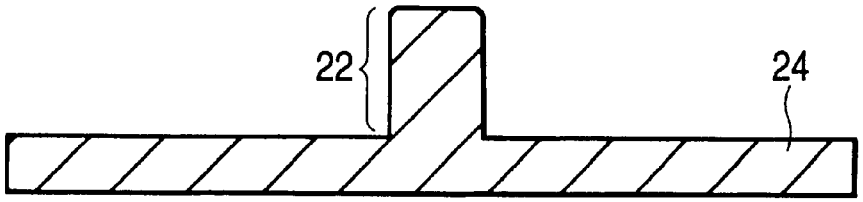
FIG. 5 is an explanatory view showing another embodiment of integral molding of the base 24 and the magnetic core 22.

FIG. 5 is an explanatory view showing another embodiment of integral molding of the base 24 and the magnetic core 22. The base 24 and the magnetic core 22 can be molded integrally as a single pole piece member by cutting, pressing, forging, or the like.

Figure 6A:
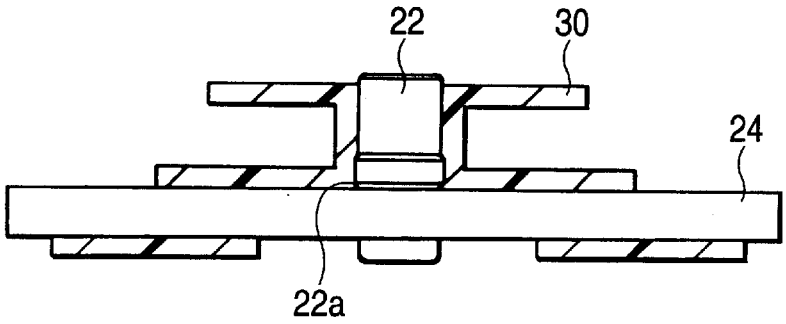
FIG. 6A is an explanatory view showing another embodiment of integral molding of the base 24, the magnetic core 22 and the coil bobbin 30.
Figure 6B:
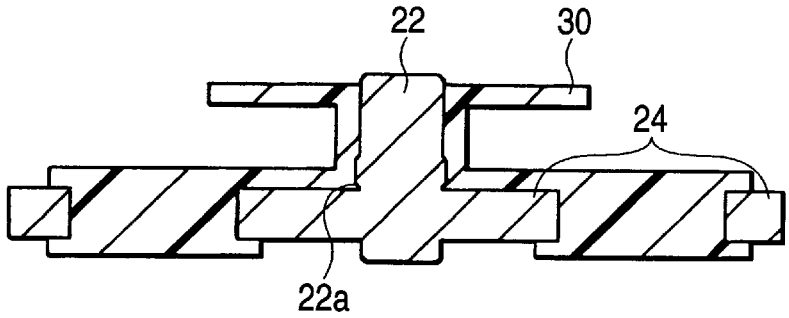
FIG. 6B is a sectional view taken on vertical center line of FIG. 6A.

FIG. 6A is an explanatory view showing another embodiment of integral molding of the base 24, the magnetic core 22 and the coil bobbin 30. FIG. 6B is a sectional view taken on vertical center line of FIG. 6A. In the same manner as in FIGS. 4A and after the base 24 and the magnetic core 22 are integrated by caulking, the base 24 and the magnetic core 22 are mounted on a mold for the coil bobbin 30 so as to be insert-molded. Here, an undercut 22*a* is formed in the circumferential surface of the magnetic core 22 so as to prevent the coil bobbin 30 from being detached.

Figure 7:
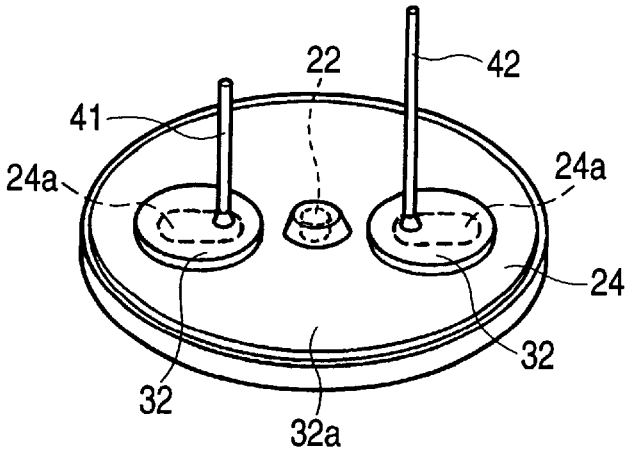
FIG. 7 is a perspective view showing the back surface side of the base 24 according to another embodiment of the present invention.
Figure 8A:
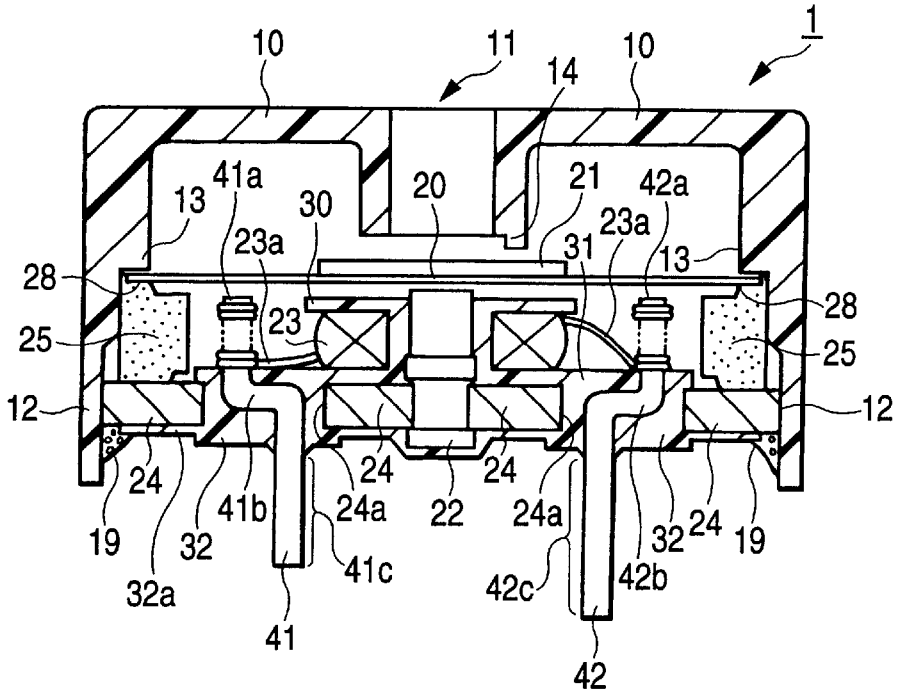
FIG. 8A is a sectional view taken on vertical center line showing the embodiment of the present invention.
Figure 8B:
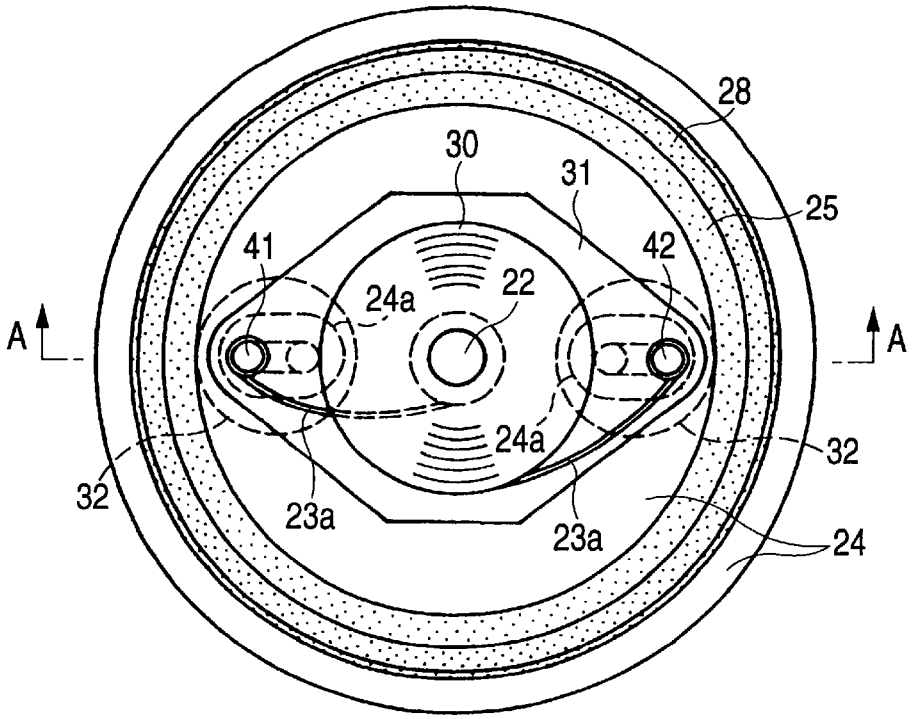
FIG. 8B is a plan view showing the state where a magnet 25 has been put on the base 24.

FIG. 7 and FIGS. 8A and 8B show another embodiment of the present invention. FIG. 7 is a perspective view showing the back surface side of the base 24. FIG. 8A is sectional view taken on vertical center line of FIG. 7. FIG. 8B is a plan view showing the state where the magnet 25 has been put on the base 24.

This embodiment has a configuration similar to that in FIGS. 1 and 2 and FIGS. 3A and 3B, except the shape of the electrically insulating portion 32 is different.

The electrically insulating portion 32 is molded integrally by insert molding or the like so as to have a coating portion 32*a* extending to the vicinity of the circumferential edge of the base 24, and cover substantially all the external exposed surfaces of the base 24 and the magnetic core 22.

A filler 19 of a bonding agent, molding resin, or the like, is applied between the circumferential wall 12 of the housing 10 and the base 24. Thus, the metal exposed surface of the transducer 1 is insulated and sealed by the coating portion 32*a* and the filler 19.

In the configuration in FIGS. 1 and 2 and FIGS. 3A and 3B, the base 24 and the magnetic core 22 are partially exposed to the outside. Thus, the bottom surface of the transducer 1 may be wholly sealed by the filler 19 in accordance with application or product specifications. In such a case, a large quantity of the filler 19 is required.

On the other hand, in the configuration in FIG. 7 and FIGS. 8A and 8B, because the coating portion 32*a* is provided, the filler 19 is used only for the circumferential edge portion of the base 24. It is therefore possible to largely reduce the quantity of the filler 19 to be used. In addition, the external exposed surfaces of the base 24 and the magnetic core 22 are covered surely. It is therefore possible to prevent short-circuit, dew condensation and oxidation so that it is possible to improve the reliability and the life of the transducer 1.

As described above in detail, according to the present invention, the coil bobbin is molded integrally with the magnetic core and the base member by insert molding or the like. Thus, it is not necessary to bond the coil bobbin. It is therefore possible to improve the fixation strength of the coil bobbin to the magnetic core and the base member and it is possible to reduce the number of parts and the manufacturing cost.

Further, the electrically insulating member for electrically insulating the base member from the terminals is molded integrally with the base member by insert molding or the like. Thus, it is not necessary to bond the electrically insulating member. It is therefore possible to improve the fixation strength of the electrically insulating member to the base member and it is possible to reduce the number of parts and the manufacturing cost.

Further, the electrically insulating member is molded integrally not only with the base member but also with the terminals by insert molding or the like. Thus, it is not necessary to bond the terminals. It is therefore possible to improve the fixation strength of the terminals and it is possible to reduce the number of parts and the manufacturing cost.

Further, because the external surface of the base member is covered with the electrically insulating member, the quantity of a sealer to be used for sealing the bottom surface of the transducer can be reduced largely. In addition, the base member is not exposed to the outside. Thus, the base member can be prevented from short-circuit, dew condensation, or oxidation.

Further, a stopper portion for engaging with the electrically insulating member is formed in each of the terminals. Thus, it is possible to improve the fixation strength of the terminals to the electrically insulating member.

Further, the coil bobbin and the electrically insulating member are molded integrally by injection molding or the like. Thus, it is not necessary to bond the coil bobbin. It is therefore possible to improve the fixation strength of the coil bobbin to the electrically insulating member and it is possible to reduce the number of parts and the manufacturing cost.

What is claimed is:

1. An electroacoustic transducer comprising:

a base member made of magnetic material;

a magnetic core made of magnetic material and provided erectly on the base member;

a diaphragm made of magnetic material and supported with a gap between the diaphragm and a forward end of the magnetic core;

a magnet constituting a magnetic circuit together with the base member, the magnetic core and the diaphragm to provide a magnetostatic field;

a coil disposed around the magnetic core for applying an oscillating magnetic field to the magnetic circuit;

a coil bobbin interposed between the magnetic core and the coil, for holding the coil; and a housing member for receiving the base member, the magnetic core, the diaphragm, the magnet, the coil and the coil bobbin;

wherein the coil bobbin is integrally molded with the magnetic core and the base member.

2. An electroacoustic transducer comprising:

a base member made of magnetic material;

a magnetic core made of magnetic material and provided erectly on the base member;

a diaphragm made of magnetic material and supported with a gap between the diaphragm and a forward end of the magnetic core;

a magnet constituting a magnetic circuit together with the base member, the magnetic core and the diaphragm to provide a magnetostatic field;

a coil disposed around the magnetic core for applying an oscillating magnetic field to the magnetic circuit;

a housing member for receiving the base member, the magnetic core, the diaphragm, the magnet and the coil;

a terminal for supplying an electric current from an outside to the coil;

an electrically insulating member for electrically insulating the terminal from the base member; and a coil bobbin for holding the coil, the coil bobbin is integrally molded with the magnetic core and the base member, wherein the electrically insulating member is molded integrally with the base member, and wherein the electrically insulating member is not molded integrally with the housing member.

3. The electroacoustic transducer according to claim 2, wherein the electrically insulating member is molded integrally with the terminal.

4. The electroacoustic transducer according to claim 3, wherein an external surface of the base member is covered with the electrically insulating member.

5. The electroacoustic transducer according to claim 2, wherein an external surface of the base member is covered with the electrically insulating member.

6. The electroacoustic transducer according to claim 2, wherein each of the terminals has a stopper portion for engaging with the electrically insulating member.

7. An electroacoustic transducer comprising:

a base member made of magnetic material;

a magnetic core made of magnetic material and provided erectly on the base member;

a diaphragm made of magnetic material and supported with a gap between the diaphragm and a forward end of the magnetic core;

a magnet constituting a magnetic circuit together with the base member, the magnetic core and the diaphragm to provide a magnetostatic field;

a coil disposed around the magnetic core for applying an oscillating magnetic field to the magnetic circuit;

a housing member for receiving the base member, the magnetic core, the diaphragm, the magnet and the coil;

a terminal for supplying an electric current from an outside to the coil; and an electrically insulating member for electrically insulating the terminal from the base member, wherein the electrically insulating member is molded integrally with the base member, and wherein the electrically insulating member is not molded integrally with the housing member, wherein the terminals has a stopper portion for engaging with the electrically insulating member, and wherein the stopper portion of the terminal is a bending portion formed in the middle of the terminal.

* * * * *